US010576527B2

(12) United States Patent
Mayoral Rojals et al.

(10) Patent No.: US 10,576,527 B2
(45) Date of Patent: Mar. 3, 2020

(54) METHODS FOR LOADING BLANKS AND SYSTEMS

(71) Applicant: ABB SCHWEIZ AG, Baden (CH)

(72) Inventors: David Mayoral Rojals, Matadepera (ES); Roger Pons Bertran, La Torre de Claramunt (ES)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/547,755

(22) PCT Filed: Feb. 5, 2015

(86) PCT No.: PCT/EP2015/052391
§ 371 (c)(1),
(2) Date: Jul. 31, 2017

(87) PCT Pub. No.: WO2016/124241
PCT Pub. Date: Aug. 11, 2016

(65) Prior Publication Data
US 2018/0085815 A1 Mar. 29, 2018

(51) Int. Cl.
*B21D 43/24* (2006.01)
*B65G 59/02* (2006.01)
(Continued)

(52) U.S. Cl.
CPC ..... *B21D 43/24* (2013.01); *B65H 3/0816* (2013.01); *B65H 3/16* (2013.01); *B65H 3/48* (2013.01);
(Continued)

(58) Field of Classification Search
CPC ..... B21D 43/24; B21D 43/20; B65H 3/0816; B65H 3/48; B65H 3/16; B65H 7/02;
(Continued)

(56) References Cited

U.S. PATENT DOCUMENTS 4,105,925 A * 8/1978 Rossol ..... G01B 11/002 250/559.36
4,178,632 A * 12/1979 Anthony ..... B25J 9/161 318/568.14
(Continued)

FOREIGN PATENT DOCUMENTS

EP 2177326 A2 4/2010
EP 2195267 B1 3/2011
(Continued)

OTHER PUBLICATIONS

International Search Report and Written Opinion of the International Searching Authority, Search Report, Application No. PCT/EP2015/052391, International Filing Date Feb. 5, 2015, ISR dated Oct. 8, 2015, 12 pages, issued by the European Patent Office, Rijswijk, Netherlands.

*Primary Examiner* — Gregory W Adams
(74) *Attorney, Agent, or Firm* — Peter B. Scull; HDC IP Law LLP

(57) ABSTRACT

A method for loading blanks from a stack of blanks to a head press of a stamping press line is provided. The method may include: providing a loading robot; providing one or more separating robots configured to separate one blank at the top of a stack of blanks from the underlying blanks; providing a stack of blanks and applying separating robots to at least one side of the stack; recognizing the position of the stack of blanks using the position of the separating robots; picking up the blank located at the top of the stack of blanks with the loading robot, using the recognized position of the stack; loading the blank to the head press of the stamping press line using the loading robot. Furthermore disclosed is a system for loading blanks to a head press of a stamping press line.

14 Claims, 5 Drawing Sheets

(51) Int. Cl.
*B65H 3/46* (2006.01)
*B65H 3/08* (2006.01)
*B65H 3/16* (2006.01)
*B65H 3/48* (2006.01)

(52) U.S. Cl.
CPC .... *B65H 2555/31* (2013.01); *B65H 2701/173* (2013.01)

(58) Field of Classification Search
CPC ..... B65H 3/443; B65H 1/28; B65H 2511/10; B65H 2553/40; B65H 2701/176; B28D 5/0011; B28D 5/0064; B65G 59/04
See application file for complete search history.

(56) References Cited

U.S. PATENT DOCUMENTS 4,392,766 A * 7/1983 Blunt ..... B25J 9/045 271/107
4,562,551 A * 12/1985 Inaba ..... B25J 9/1602 318/568.13
4,768,913 A * 9/1988 Baba ..... B21D 43/24 271/159
5,392,630 A * 2/1995 Marinoni ..... B21D 43/24 414/797
5,542,658 A * 8/1996 Wirz ..... B65H 3/0883 271/107
5,943,476 A * 8/1999 Dougherty ..... B25J 9/1694 700/251
6,006,638 A 12/1999 Eltringham
6,468,025 B1 10/2002 Stumpf et al.
6,611,345 B1 * 8/2003 Luxem ..... B65H 7/14 356/614
6,746,203 B2 * 6/2004 Leblanc ..... B65G 59/005 294/907
7,272,524 B2 * 9/2007 Brogardh ..... B25J 9/1671 700/193
7,848,851 B2 * 12/2010 Nishi ..... B25J 9/1674 700/251
2008/0316306 A1 * 12/2008 Burkle ..... B25J 9/1697 348/86
2010/0266380 A1 10/2010 Dorner et al.
2010/0269555 A1 10/2010 Theis et al.
2013/0108408 A1 * 5/2013 Saison ..... B65H 3/0816 414/797

FOREIGN PATENT DOCUMENTS

EP 1973824 B1 12/2012
FR 2973019 A1 * 9/2012 ..... B21D 43/24
JP S5574932 6/1980
JP S5574932 A 6/1980
JP 59230927 A * 12/1984 ..... B21D 43/24
JP 10071441 A * 3/1998 ..... B21D 43/24
JP 2010029878 A 2/2010
JP 5473234 B2 4/2014

* cited by examiner

METHODS FOR LOADING BLANKS AND SYSTEMS

The present disclosure relates to methods for loading blanks to a head press of a stamping press line, and to systems thereof.

BACKGROUND

In the production of stamped or pressed metal parts, stamping press lines may be supplied with metal blanks that have previously been cut from a metal coil in a separate blanking line. The blanks may be shear-cut metal blanks of a predetermined length or they may be contoured blanks cut with a blanking die.

The use of industrial robots for picking blanks from a stack at a pick-up position and loading them in a stamping press line, such as those for manufacturing vehicle body parts is known.

In known systems, a first industrial loading robot collects the blanks from a stack of blanks. The blanks at the top of the stack e.g. blanks made of magnetic material may be maintained slightly separated from each other at least at the edges, for example by magnets, to prevent them from adhering to each other and thus preventing the first loading robot from picking more than one blank, which would cause serious problems.

The first industrial robot situates the blank located at the top of the stack in a centering station e.g. a gravity table to get the blank centered. Alternatively, the blank may be located using e.g. a vision system. A second industrial loading robot collects the centered or located blank and feeds the blank to the head press of the stamping press line. Centering or locating of the blanks is generally required because the stacks of blanks may be inaccurately placed in the pick-up position by a forklift truck, and also because of the inaccurate position of the stack on the supporting element e.g. pallet which doesn't allow for the accuracy needed to load the blank into a press.

With this arrangement, at least two industrial robots and a centering device are required for the de-stacking and loading operation.

In low cost and/or low output rate requirement cases, it might be desirable to provide a simpler solution that allows working with a single loading robot, and at the same time removing the need for a costly centering or locating system.

SUMMARY

In a first aspect, a method for loading blanks from a stack of blanks to a head press of a stamping press line is provided. The method may include: providing a loading robot; providing one or more separating robots configured to separate one blank at the top of a stack of blanks from the underlying blanks; providing a stack of blanks and applying separating robots to at least one side of the stack; recognizing the position of the stack of blanks using the position of the separating robots; picking up the blank located at the top of the stack of blanks with the loading robot, using the recognized position of the stack; loading the blank to the head press of the stamping press line using the loading robot.

Accordingly, the position of the stack of blanks may be recognized using the position of the separating robots. The movement of the loading robot may be adapted in order to pick up the blank from the right recognized position of the stack of blanks. In this way, the loading robot is capable of loading the blank to the correct position at the head press of the stamping press line. Therefore, the picking position will be, normally, different for each stack, while the dropping position into the head press will be always the same.

With this arrangement, a single loading robot can be used. Furthermore, the use of some other centering element e.g. a centering table in order to get the blank centered or location systems e.g. a vision system is avoided, thus there is a substantial cost saving. In addition, the space used near the head press of the production press line may be optimized since only a single robot is required near the head press of the stamping press line.

The separating robots may be used to separate one blank at the top of the stack of blanks from the underlying blanks and to recognize the position of the stack of blanks, thus the use of the robots may be optimized due to the fact that different functions may be carried out by the same robots.

In a second aspect, a system for loading blanks to a head press of a stamping press line may be provided. The system may include a loading robot and one or more separating robots; each separating robot may have one or more separating tools configured to separate one blank located at the top of the stack of blanks from the underlying blanks. Furthermore, the separating robots may be arranged to recognize the position of the stack of blanks, and to provide the recognized position to a loading robot.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
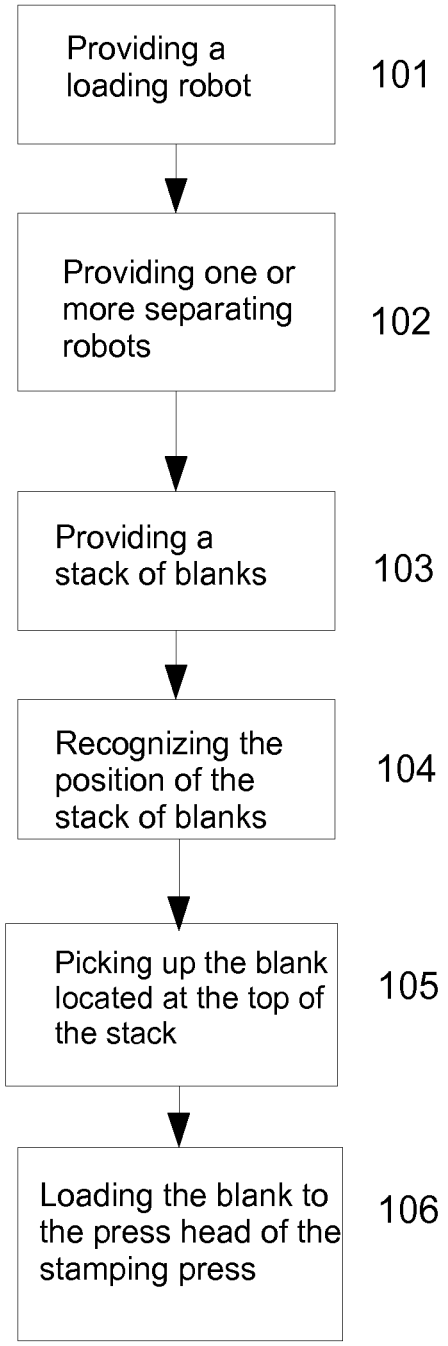
FIG. 1 is an illustration of a block diagram describing an example of a method for loading blanks to a head press of a stamping press line.

FIG. 1 is an illustration of a block diagram describing an example of a method for loading blanks to a head press of a stamping press line.

At block 101, a loading robot may be provided. At block 102, one or more separating robots configured to separate one blank located at the top of the stack of blanks from the underlying blanks are provided. At block 103, a stack of blanks may be provided and the separating robots may be applied against at least one side of the stack of blanks.

At block 104, the position of the stack of blanks may be recognized using the position of the separating robots. Then, at block 105, the blank located at the top of the stack of blanks may be picked up with the loading robot using the recognized position of the stack, such that the loading robot may pick up the blanks in an accurate way, taking into account the position of each stack of blanks, without the need for a centering or locating system.

With this arrangement, at block 106, the blank may be properly picked and loaded in the desired position to the head press of the stamping press line.

Moreover, the use of a second robot may be avoided. Other centering or locating solutions are also avoided such as centering tables or vision systems.

Figure 2:
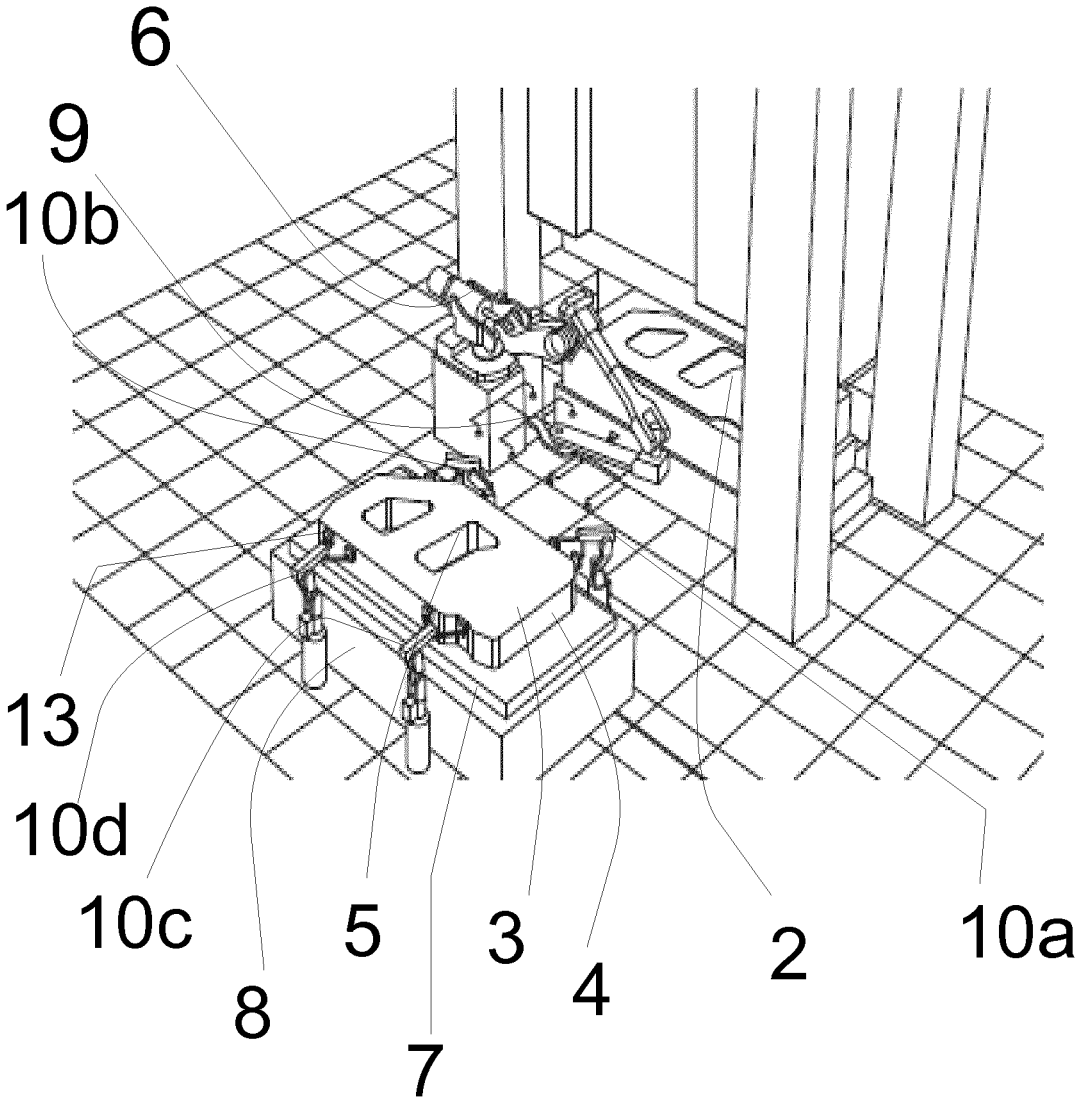
FIG. 2 is a perspective view of a loading station of a head press of a stamping press line with an implementation of a system for picking and loading blanks.

FIG. 2 shows a system for picking and loading blanks according to an implementation hereof, in a loading station of a head press of a stamping press line.

More particularly, FIG. 2 shows very schematically a head press of a stamping press line 2, which may receive a blank 3 from a stack 4 of blanks located at a pick-up position 5.

A loading robot 6, for example a suitable industrial robot, may be used to feed the press line 2. The stack 4 of blanks may be located on a stacking support 7 configured to hold the stack of blanks. The stacking support 7 is shown only schematically in this figure, and may be of any known type.

The stacking support 7 may have or include a carriage 8 which may be displaceable along a track (not shown). The carriage 8 may be driven by a linear motor (not shown) but other options may be possible. The stacking support 7 may be provided with a load detector (not shown) to detect that the stack 4 of blanks is exhausted, or that only a predetermined number of blanks remain.

The loading robot 6 may have at least four axes. The loading robot 6 may include a tooling 9 with suction cups suitable for handling the blank although in some other implementations the tooling may include e.g. magnets suitable for handling the blank 3. The tooling 9 may be attached at the distal end of the loading robot 6. The loading robot 6 is schematically shown mounted on the floor but some other configurations may be possible, e.g. roof or shelf mounted.

An example of a loading robot that may be employed in a loading station hereof may be but is not limited to robot IRB 6650S, available from ABB (www.abb.com), with an additional rotational $7^{th}$ axis, among other robots.

The loading robot 6 may have a first base of coordinates e.g. an absolute base of coordinates. The first base of coordinates may have its zero point in the base of the loading robot. A loading point, which is the point suitable for properly load the blank to the head press of a stamping press line, may be defined in the first base of coordinates. The loading point into the press line defined in the first base of coordinates would generally be the same for every stack of blanks that is placed at the pick-up position 5 and it is suitable to be loaded to the head press of the press line.

The loading robot 6 may be controlled by a controller (not shown) to program a pick-up point, pick up the blank 3 at the top of the stack 4, and load it at the previously defined loading point on the head press of the stamping press line 2 in the correct position. As will be described further below, the loading robot 6 may use a second base of coordinates e.g. a temporal base of coordinates which is based on the position of the stack of blanks and therefore is different for each stack of blanks that is placed at the pick-up position 5 and may be configured to be picked and loaded by the loading robot 6.

The position of the stack of blanks may be recognized and transmitted to the loading robot 6 by, for example, one or more of at least one separating robot. The position of three points will be sufficient to recognize with enough accuracy the position of the stack. For very simple blanks, such as rectangular blanks, one or two robots may be enough; in most common cases more than three separating robots may be convenient.

The pick-up point for the blanks may be defined in the second base of coordinates, thus the blanks of the stack may be correctly picked up with enough accuracy at the right position, account being taken of the differences in position between one stack and another, and then loaded to the head press of the press line.

The system for picking and loading blanks may include one or more separating robots, in order to separate one blank at the top of the stack from the underlying blanks: this prevents the loading robot from picking up more than one blank, and avoids the risk of the loading robot loading two or more blanks to the head press of the press line, thus causing serious problems to the press line. In some examples, the loading robot may be equipped with a double blank detector in order to avoid taking more than one blank.

In the implementation shown in FIG. 2 the system for picking and loading blanks includes four separating robots 10*a*, 10*b*, 10*c* and 10*d*.

Throughout the present description and claims the term "separating robots" is to be understood as encompassing industrial robots which are defined as an automatically controlled, reprogrammable, multipurpose manipulator programmable in three or more axes or manipulators with at least two degrees of freedom.

An example of an industrial robot suitable to be employed as a separating robot in such a handling system may be but is not limited to IRB 260, IRB 1200 or IRB 1600, available from ABB (www.abb.com), among others.

Each separating robot 10*a*, 10*b*, 10*c* and 10*d* may be provided with a separating tool 13, e.g. a magnetic or other device provided at its distal end. When a magnetic device is employed this creates a magnetic field, thus the blank situated on the top of the stack may be slightly separated from the underlying blanks of the stack of blanks 4. In some alternatives, the separating tool may be a blower tool configured to inject air between the blanks, or may combine both a magnetic and a pneumatic effect. The separating tool may be applied against one side or two sides of the stack 4 of blanks.

In the particular case of the separating tool applied against two sides, the separating robot (and thus the separating tool) may be located at or near the vertex defining the intersection of two sides of the stack of blanks. With this arrangement, the separating tool may be applied at the same time against two sides of the stack of blanks.

By the use of the separating tools, the blank at the top of the stack 4 that is prepared to be picked by the robot 6 may be slightly separated from the second blank, usually along its edges As described above, the separating tool may be magnetic but other implementations are possible. For example, in the case of blanks on non-magnetic materials such as aluminum, the tool may inject air between the blanks to separate them. Another option may be to apply a mechanical friction force on the upper edge of the blank that is at the top of the stack, so as to lift it slightly, in this case, the mechanical friction may be applied to either magnetics and non-magnetics blanks.

The plurality of separating robots 10*a*, 10*b*, 10*c* and 10*d* may be controlled jointly, such that the separating robots may act simultaneously on the blank(s) to separate it from the stack of blanks 4.

Controllers or control units that may operate robots jointly may be but are not limited for example to those available from ABB (www.abb.com) which include the function MultiMove; MultiMove is a function embedded e.g. into ABB's IRC5 control module, that allows control of the axes of several manipulators such that they work like a single robot.

The position of the stack of blanks may be recognized by determining the tool center point (TCP) of the separating tool of one or more of each of the separating robots 10*a*, 10*b*, 10*c*, 10*d*. The tool center point (TCP) is the point in relation to which all robot positioning is defined. The tool center point is defined as X, Y, Z distance relative to a robot wrist of each separating robot. With this arrangement, the tool center point may coincide with, for example, the magnetic device provided at each separating robot. This way, the position of the tool center point (TCP) (and thus the separating tool) may be recognized, thus the position of the stack of blanks may also be recognized.

In further examples, a sensor system (not shown) may be provided to recognize the actual position of the stack of blanks, for example its X, Y and Z coordinates and its angular position. For example, the sensor system may be arranged at or near one or more or each separating tool of each separating robot. This way, when the separating robots 10*a*, 10*b*, 10*c*, 10*d* (and thus the separating tool of each separating robot) are applied against the stack 4 of blanks, the position of the sensor itself (and thus the position at or near the separating tool) may be sensed, thus the position of the stack of blanks may also be recognized. In yet further examples, the sensor system may be located in some other suitable locations on the separating robots.

In this particular example, the separating robots 10*a* and 10*b* are applied against one side of the stack of blanks and the separating robots 10*c* and 10*d* are applied against the opposite side of the stack of blanks, although some other configuration of the layout of the robots against the stack of blanks may be possible.

The system may also have the appropriate control and/or output units to calculate from the readings of the sensors the actual position of stack of blanks and to transmit this information to the loading robot 6.

The actual position of the stack of blanks may be recognized by the separating robots 10*a*, 10*b*, 10*c*, 10*d*. This information may be transmitted to the loading robot. The loading robot may use the information transmitted by the separating robots to generate a second base of coordinates. With this arrangement, a pick-up point where the blank located at the top of the stack has to be picked up may be defined.

In this particular example, the stack 4 of blanks may be one stack of blanks although some other options may be possible. For example, the stack of blanks may be formed with a plurality of stacks of blanks. In this way, the plurality of stacks of blanks may be situated on the stacking support. The plurality of stacks of blanks may be situated parallel to each other in the direction of the flow of the press stamping line although some geometrical distributions may be possible. In the particular case of two stacks of blanks, the operation of the system may be described as follows: the position of a blank at the top of the first stack and the second stack may be determined. The position of the blank at the top of the first and second stack may be provided to the loading robot. A default coordinate system of the loading robot may be corrected creating a temporal coordinate system based on the positions provided. The loading robot may pick up a first blank situated at the top of the first stack of blanks and a second blank situated at the top of the second stack blanks simultaneously. The stamping press line may be fed with the first and second blanks at the same time and in the right position (centred), thus the feed rate of the line may be increased with high accuracy as to the positioning of the blank. The blanks of the plurality of stacks can also be taken independently. In this case, different temporal coordinate systems will be used for each stack.

One implementation of the method for loading blanks to the head press of the stamping press line 2 that employs such a system for picking and loading blanks will now be described in more detail with reference to FIGS. 2 to 4.

In FIG. 2, the loading robot 6 is moving towards the stack 4 in order to pick up a blank 3. The plurality of separating robots 10*a*, 10*b*, 10*c* and 10*d* may have the separating tools 13 activated, thus the blank situated on the top of the stack 4 of blanks may be maintained slightly separated. As blanks are removed from the stack 4, and unless the stacking support 7 is provided with a lift, the height of the stack 4 will decrease; the separating robots 10*a*, 10*b*, 10*c*, 10*d* may then progressively adjust the position of the separating tools 13 to the stack 4 height.

The number of blanks remaining on the stack 4 may be controlled, for example by a load detector (not shown); alternatively, the number or remaining blanks may be determined depending on the height of the separating robots 10*a*, 10*b*, 10*c*, 10*d*, because these robots place the separating tool adjacent the blank at the top of the stack, so their height at any time depends on the number of remaining blanks.

Each separating robot 10*a*, 10*b*, 10*c* and 10*d* may recognize one position i.e. the coordinates of one point of the stack of blanks. The position may be recognized at each separating robot, for example, by sensing the position of the separating tool e.g. a magnetic device or one or more additional sensors (not shown) arranged at or near the separating tool when the separating robots (and thus the magnetic device) are applied against al least two sides of the stack of blanks.

In this example, the separating robots 10*c* and 10*d* are applied against the one side of the stack 4 of blanks and the separating robots 10*a* and 10*b* are applied against the opposite side of the stack 4 of blanks.

In some other examples, the position of the stack of blanks may be recognized by determining the tool center point (TCP) of the separating tool of each separating robots 10*a*, 10*b*, 10*c*, 10*d*.

In this particular example, the separating robots 10*a*, 10*b*, 10*c* and 10*d* may use a similar sensing arrangement e.g. one or more sensors (not shown) arranged at or near the magnetic device although some other configurations may be possible, for example, the separating robots 10*a*, 10*b* may use one sensing arrangement e.g. one or more sensors (not shown) arranged at or near the magnetic device and the separating robots 10*c* and 10*d* may recognize the position of the blank by determining the tool center point.

The position recognized by the separating robots may be one or a plurality of spatial points of the stack of blanks. The spatial points may correspond to the coordinates X, Y, Z of the blank located at the stack of blanks and the orientation of the blank in the horizontal plane.

Once the position of the stack 4 of blanks is recognized using the position of the separating robots 10*a*, 10*b*, 10*c*, 10*d*, said position may be provided to the loading robot 6. The physical transfer of data may be over a point-to-point communication channel. Examples of such channels may be copper wires, optical fibres, wireless, etc.

The control system of the loading robot 6 may then use a second base of coordinates on the basis of the position of the points of the stack of blanks as recognized by the separating robots 10*a*, 10*b*, 10*c*, 10*d*. The pick-up point where the blanks have to be picked may be defined in this second base of coordinates.

This way, the loading robot 6 may be able to properly pick up the blank e.g. a blank from a skewed stack 4 of blanks at the pick-up point. As will be further described, the loading robot 6 must properly position the blank relative to the desired position to be loaded to the head press of the stamping press line.

Figure 3:
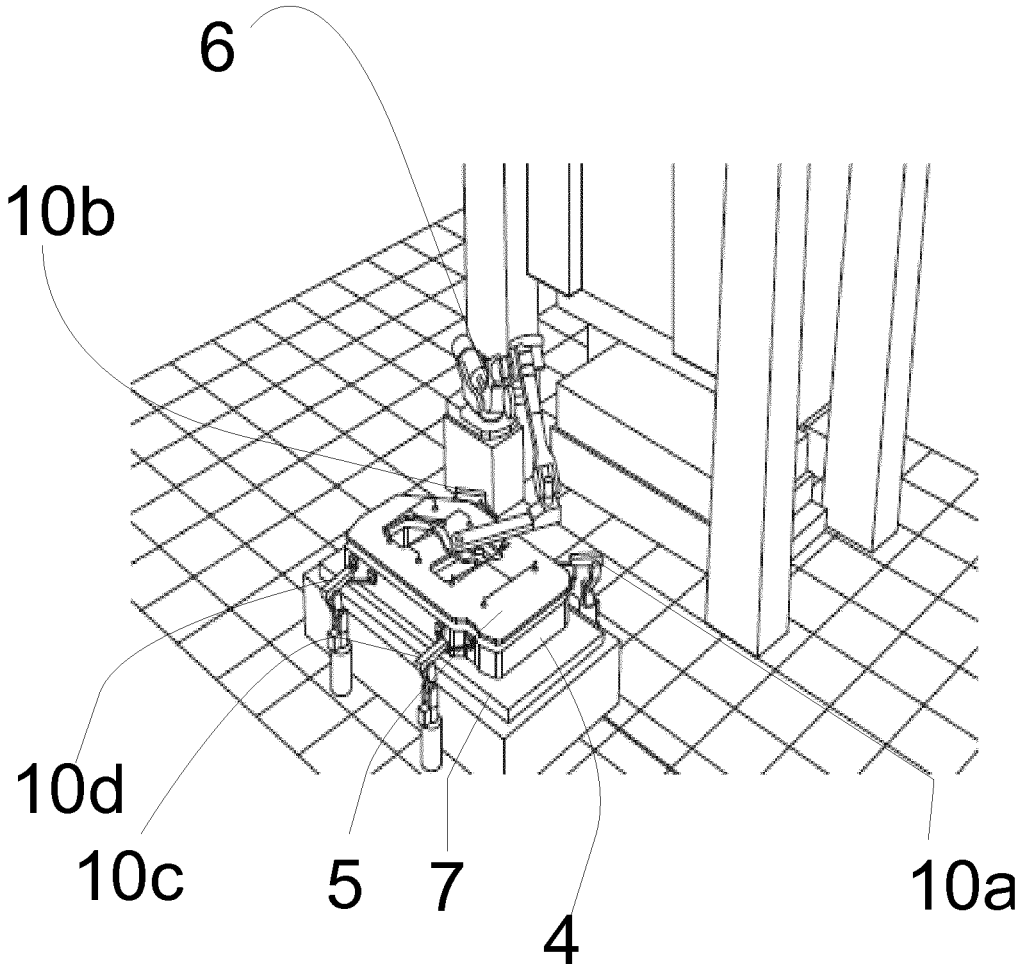
FIG. 3 is a perspective view of a loading station showing a loading robot of the system picking up a blank located at the top of the stack of blanks.

FIG. 3 shows the system picking up a blank located at the top of the stack of blanks. As described above, the loading robot 6 may use a second base of coordinates on the basis of the position of the points of the stack of blanks recognized by the separating robots. A pick-up point in order to pick up the blank located at the top of the stack may be defined in this second base of coordinates. With this pick-up point, the loading robot 6 may correctly pick-up the blank located at the top of the stack.

The stacking support 7, once the stack is emptied may be displaced from the pick-up position 5. The empty stack of blanks may be replaced with a new stack (not shown) of blanks, which may be prepared at one side of the pick-up position 5. The new stack of blanks may also be disposed on a new stacking support and carriage. The new stacking support with the new stack of blanks may be displaced towards the pick-up position at the same time as the empty stacking support removed from said position.

Figure 4:
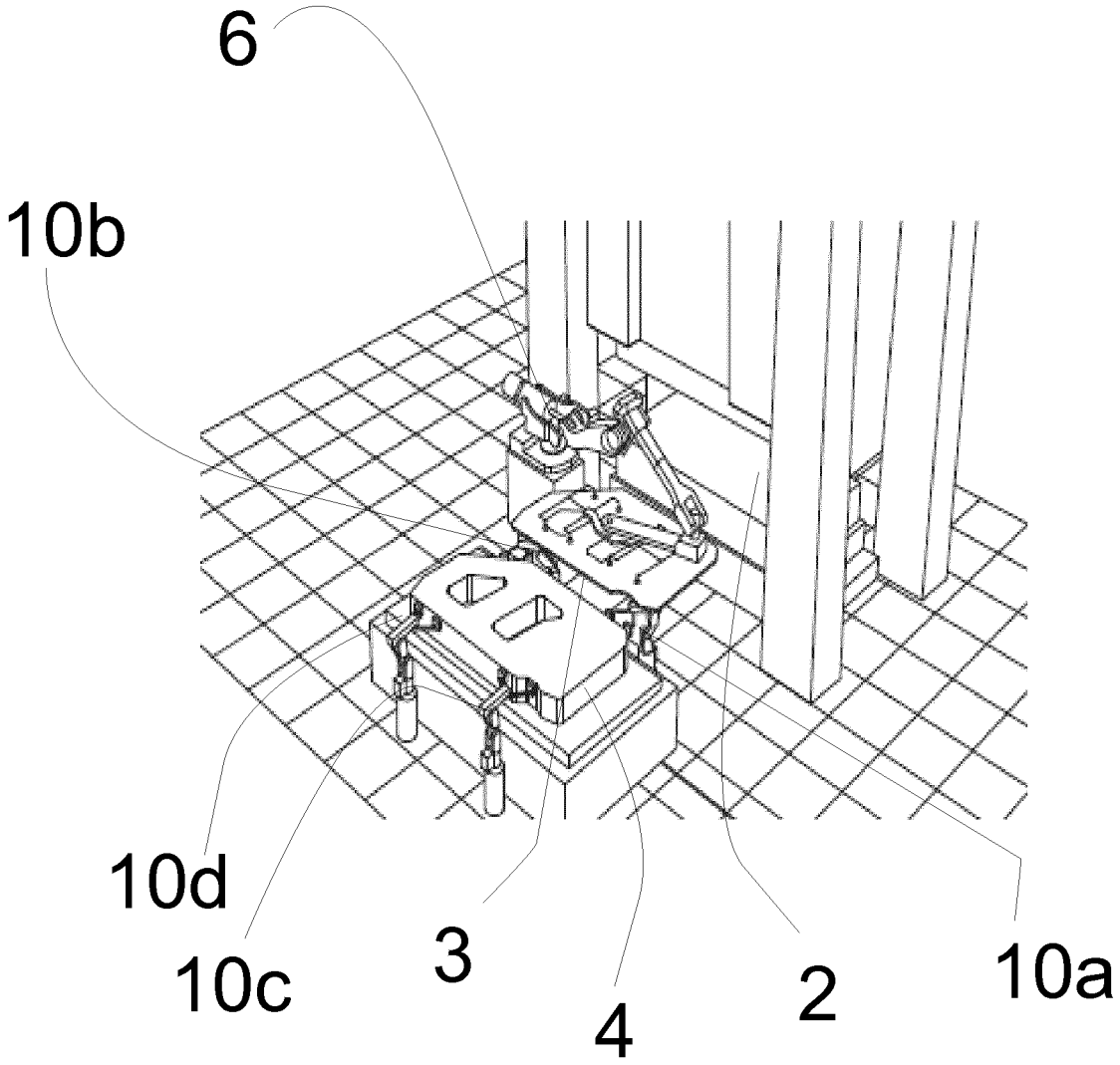
FIG. 4 is a perspective view of a loading station showing the robot moving the blank towards the head press of the stamping press line.

FIG. 4 is a perspective view of a loading station showing a robot moving the blank towards the head press of the stamping press line. As described above, the loading robot has a first base of coordinates. A loading point for loading the blanks to the head press of the press line may be defined in this first base of coordinates, and it would generally be the same loading point for different stacks of blanks, regardless of their positioning.

The loading robot 6 may pick up the blank 3 located at the top of the stack 4. Then, the loading robot 6 (and thus the blank 3) may be moved towards the loading point defined in the first base of coordinates of the loading robot located at the head press 2 of the press line where the blank 3 has to be properly loaded.

Figure 5:
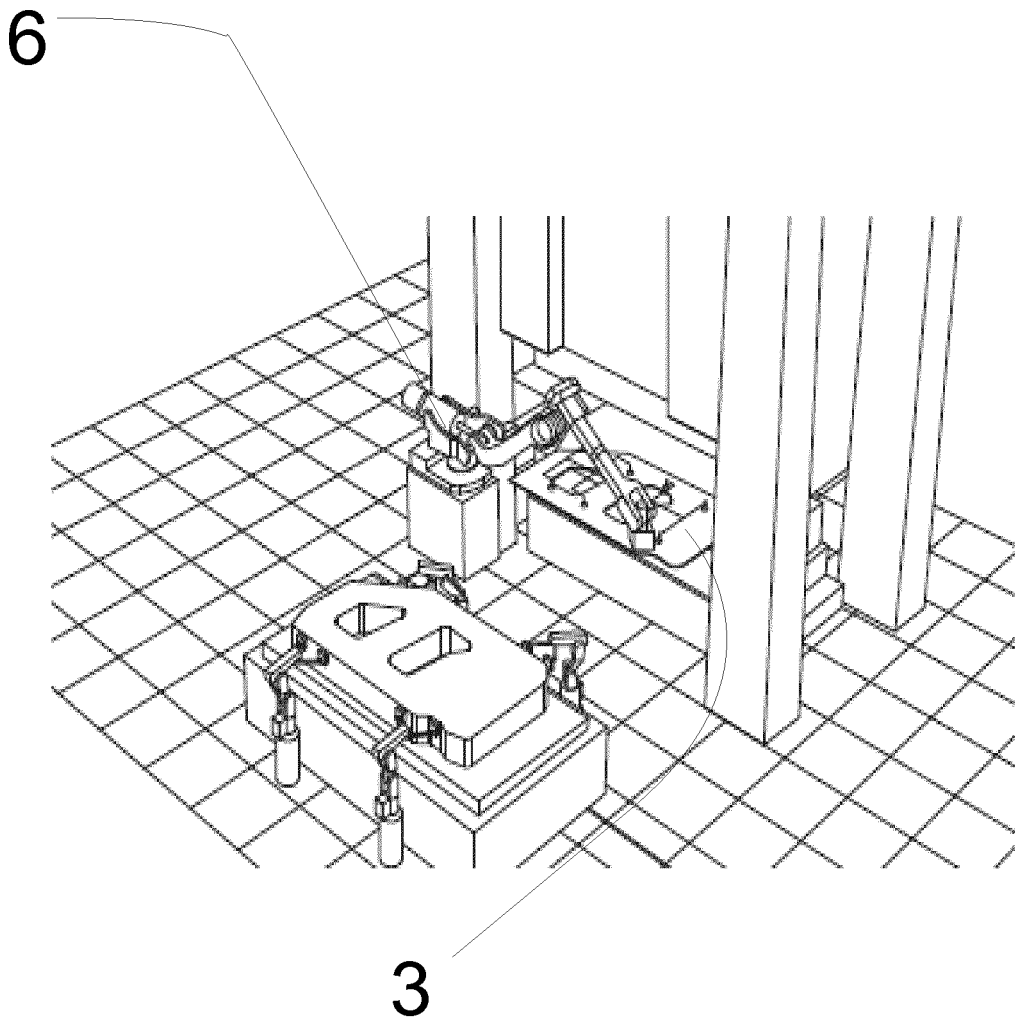
FIG. 5 is a perspective view of a loading station showing the robot loading the blank to the head press of the stamping press line.

FIG. 5 shows a system for picking and loading blanks loading the blank to the head press of the stamping press line. This is performed using a loading robot 6. The loading robot 6 has picked up the blank as described in and for previous figures and it is ready to load the blank, such that the blank is properly positioned relative to the desired position to be loaded to the head press of the stamping press line. In this way, the use of centering elements e.g. such as gravity tables or locating systems e.g. such as vision systems may be avoided. Furthermore, the blank may be loaded using a single robot.

It may further be noted that in FIGS. 2-5 the separating robots and the loading robots are shown only very schematically. The structure, details and operating parameters of the separating robots and the loading robot are known by the person skilled in the art, who will be able to employ both types of robots with the most suitable features for any particular application. For example, the robots may be 4-axes, 5-axes or 6-axes, the layouts of the separating robots may be decided on the basis of the position that the wrist may adopt and/or the space available in each particular application.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A method for loading blanks from a stack of blanks to a head press of a stamping press line comprising:

providing a stack of blanks having at least one blank at the top of the stack of blanks and one or more underlying blanks;

providing a loading robot;

providing one or more separating robots configured to separate at least one blank at the top of the stack of blanks from the one or more underlying blanks, the separating robots being industrial robots, the industrial robots being automatically controlled, reprogrammable, multipurpose manipulators programmable in three or more axes or manipulators with at least two degrees of freedom, each separating robot comprising a separating tool having at least one or both of a blower tool to inject air between the blanks or a magnet, the separating robots being configured to vertically adjust the position of the separating tool to the stack height;

applying one or more of the one or more separating robots to at least one side of the stack;

recognizing the position of the stack of blanks using the position of one or more of the separating robots;

picking up the blank located at the top of the stack of blanks with the loading robot, using the recognized position of the stack;

loading the blank to a head press of a stamping press line using the loading robot.

2. A method according to claim 1, two or more separating robots being provided.

3. A method according to claim 1, four separating robots being provided.

4. A method according to claim 1, the separating tool being applied against one side of the stack of blanks.

5. A method according to claim 1, the separating tool comprising a tool center point and the recognizing of the position of the stack of blanks being performed by recognizing the position of the tool center point of the separating tool.

6. A method according to claim 1, further comprising a sensor arrangement located on each separating robot and the recognizing of the position of the stack of blanks being performed by sensing the position of the sensor arrangement.

7. A method according to claim 1, further comprising the loading robot having a first base of coordinates, and defining in the first base of coordinates a loading point for loading the blanks to the head of the stamping press line.

8. A method according to claim 1, further comprising providing the position of the stack of blanks to the loading robot after recognizing the position of the stack of blanks.

9. A method according to claim 8, further comprising the loading robot using a second base of coordinates on the basis of the position of the stack of blanks recognized by the separating robots, and defining in the second base of coordinates a pick-up point where the blank located at the top of the stack is picked up.

10. A system for loading blanks to a head press of a stamping press line comprising:

a loading robot;

one or more separating robots, each separating robot comprising one or more separating tools configured to separate one blank located at the top of a stack of blanks from the underlying blanks, the separating robots being arranged to recognize the position of the stack of blanks, and to provide the recognized position to the loading robot, and, the separating robots being industrial robots, the industrial robots being automatically controlled, reprogrammable, multipurpose manipulators programmable in three or more axes or manipulators with at least two degrees of freedom, the separating robots being configured to vertically adjust the position of the separating tool to the stack height.

11. A system according to claim 10, the one or more separating tools comprising one or both of a magnetic device or a blower tool configured to inject air between the blanks.

12. A system according to claim 10, comprising two or more separating robots.

13. A system according to claim 10, comprising four separating robots.

14. A method for loading blanks from a stack of blanks to a head press of a stamping press line comprising:

providing a stack of blanks having a blank at the top of the stack of blanks and one or more underlying blanks;

providing a loading robot for loading blanks from the stack of blanks to the head press;

providing one or more separating robots to at least one side of the stack of blanks, for separating the blank at the top of a stack of blanks from the underlying blanks, the separating robots being industrial robots, each separating robot comprising a separating tool having at least one or both of a blower tool to inject air between the blanks or a magnetic device the separating robots being configured to vertically adjust the position of the separating tool to the stack height;

identifying the position of at least one of the one or more separating robots, the separating tool comprising a tool center point and the identifying the position of at least one of the one or more separating robots is performed by recognizing the position of the tool center point of the separating tool;

determining a pick-up point where the blank located at the top of the stack has to be picked up by the loading robot, as a function of the position of at least one of the one or more separating robots; and causing the loading robot to pick up the blank at the top of the stack of blanks, at the determined pick-up point, and to load the blank to a head press of a stamping press line.

* * * * *